US011501745B1

(12) United States Patent
Baggs et al.

(10) Patent No.: US 11,501,745 B1
(45) Date of Patent: Nov. 15, 2022

(54) MUSICAL INSTRUMENT PICKUP SIGNAL PROCESSING SYSTEM

(71) Applicant: Lloyd Baggs Innovations, LLC, Nipomo, CA (US)

(72) Inventors: Lloyd R. Baggs, Nipomo, CA (US); Thomas Linn, Nipomo, CA (US)

(73) Assignee: Lloyd Baggs Innovations, LLC, Nipomo, CA (US)

( * ) Notice: Subject to any disclaimer, the term of this patent is extended or adjusted under 35 U.S.C. 154(b) by 0 days.

(21) Appl. No.: 16/872,100

(22) Filed: May 11, 2020

Related U.S. Application Data

(60) Provisional application No. 62/846,516, filed on May 10, 2019.

(51) Int. Cl.
*G10H 1/12* (2006.01)
*G10H 1/00* (2006.01)
*G10H 3/14* (2006.01)

(52) U.S. Cl.
CPC ..... *G10H 1/12* (2013.01); *G10H 1/0033* (2013.01); *G10H 3/14* (2013.01)

(58) Field of Classification Search
CPC ..... G10H 1/12; G10H 1/0033; G10H 3/14
See application file for complete search history.

(56) References Cited

U.S. PATENT DOCUMENTS 6,023,019 A 2/2000 Baggs
6,605,771 B1 8/2003 Baggs
7,135,638 B2 11/2006 Garrett et al.
7,157,640 B2 1/2007 Baggs et al.
8,989,399 B2 3/2015 Baggs
9,099,066 B2 * 8/2015 Welch ..... G10H 1/02
9,280,964 B2 3/2016 Lin et al.
9,583,088 B1 * 2/2017 May ..... G10H 3/186
2006/0147050 A1 7/2006 Geisler
2008/0034946 A1 2/2008 Aimi
2009/0173218 A1 7/2009 Kuroki
2010/0260347 A1 10/2010 Baggs
2014/0260906 A1 * 9/2014 Welch ..... G10H 1/02 84/603
2014/0270215 A1 * 9/2014 Lin ..... G10H 3/186 381/61
2017/0076705 A1 * 3/2017 Iori ..... G10H 1/12
(Continued)

*Primary Examiner* — Jeffrey Donels
(74) *Attorney, Agent, or Firm* — KPPB LLP

(57) ABSTRACT

Systems and methods for creating a digital audio filter, such as an impulse response filter, using a pickup audio signal provided to an instrument signal capture device and a microphone signal provided to a mobile device are disclosed. In one embodiment, a method includes capturing a first audio signal using a signal capture device, performing frequency analysis on the digitized first audio signal to generate a frequency response spectrum representation, transmitting the frequency response spectrum representation of the first audio signal from the signal capture device to a mobile device, capturing a second audio signal using a microphone on the mobile device, performing frequency analysis on the at least one digitized second audio signal using the mobile device to generate a frequency response spectrum representation, and generating a digital audio filter from the frequency response spectrum representations of the first audio signal and the second audio signal.

20 Claims, 4 Drawing Sheets

(56) References Cited

U.S. PATENT DOCUMENTS

| | | | | |
|---|---|---|---|---|
| 2020/0202882 | A1* | 6/2020 | Baker | G10L 21/0232 |
| 2020/0280816 | A1* | 9/2020 | Eronen | H04S 7/305 |
| 2021/0183353 | A1* | 6/2021 | Zhang | G10K 11/17815 |

* cited by examiner

MUSICAL INSTRUMENT PICKUP SIGNAL PROCESSING SYSTEM

CROSS-REFERENCE TO RELATED APPLICATIONS

This application claims priority to U.S. Provisional Application No. 62/846,516 entitled "Musical Instrument Pickup Signal Processing System" to Baggs et al., filed May 10, 2019, the disclosure of which is incorporated herein by reference in its entirety.

FIELD OF THE INVENTION

The present invention relates generally to stringed musical instrument pickups and more specifically to processing a pickup audio signal to generate a digital audio filter, such as an impulse response filter.

DETAILED DISCLOSURE OF THE INVENTION

Figure 1:
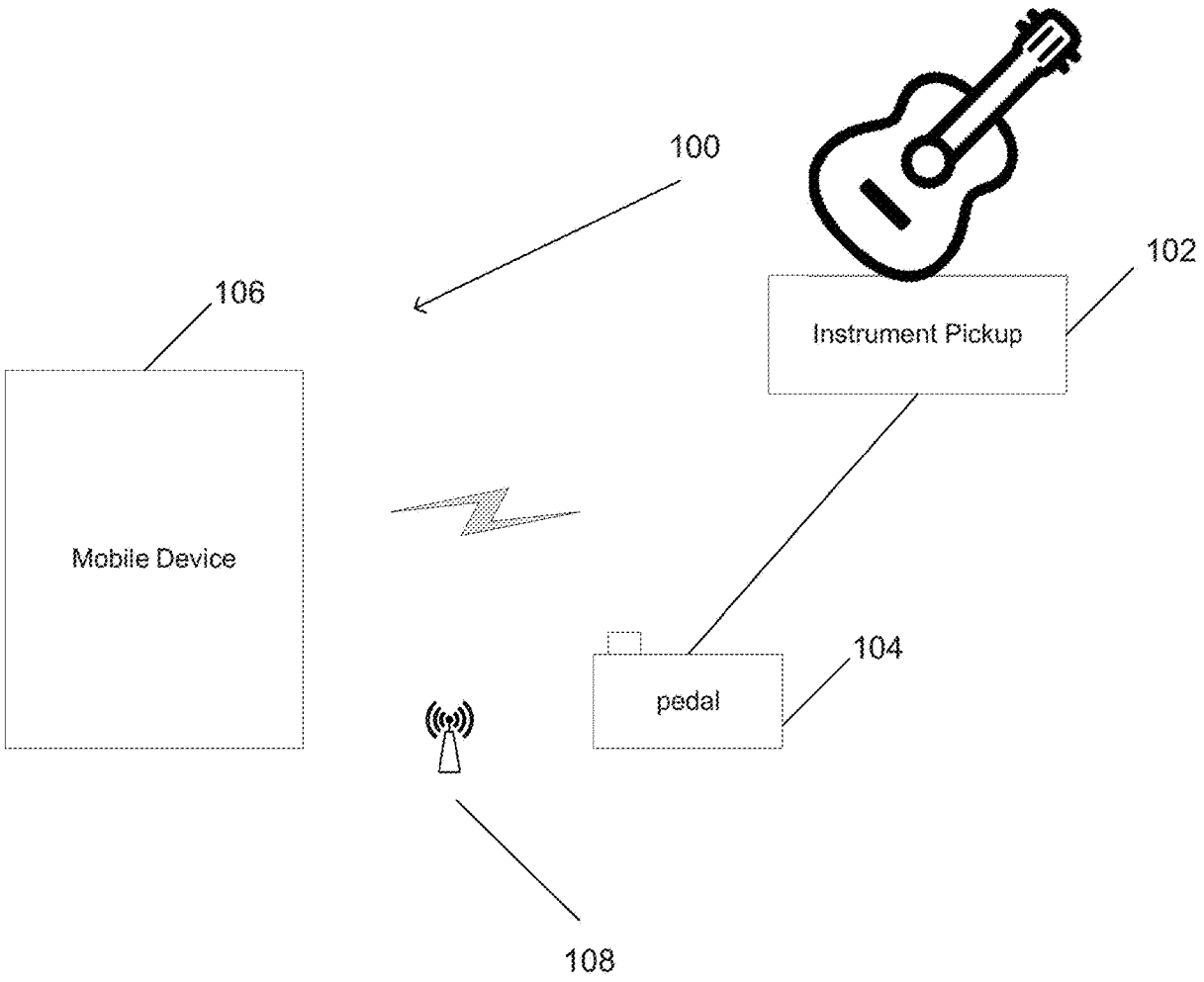
FIG. 1 is a system diagram of a signal processing system in accordance with several embodiments of the invention.

Turning now to the drawings, signal processing systems utilizing impulse response filters in accordance with embodiments of the invention are disclosed. In live performances, often the most convenient or practical method of instrument amplification is not the best or most accurate sounding to listeners. Different types of instrument pickups, such as magnetic or transducer pickups on acoustic guitars, typically have physical or mechanical limitations that impart a certain quality to the sound that can sound artificial or missing something. Microphones are many times the most accurate way to capture and reproduce the sound from an instrument, but can be tedious or difficult to put to use in some environments. In particular, a microphone can be sensitive to placement in relation to the instrument, not evenly capturing a full band of audible frequencies. In addition, it can be prone to feedback.

One way of emulating the sound of a microphone using a pickup is to create an impulse response filter that reflects a comparison or difference between the frequency response spectrums produced by a pickup and a microphone both capturing the same sound from an instrument, and then subsequently apply the impulse response filter to audio captured by the corresponding pickup to impart the qualities of a microphone to the pickup audio without needing to use a microphone. Many conventional methods of creating an impulse response filter are inconvenient to use, or sound artificial, or both. They can require high bandwidth in capturing an audio signal and computing resources in creating the impulse response filter. This may need a high-quality studio microphone and a great deal of computing power to achieve. It often involves recording a long sound track (such as with a WAV sound file) and processing it altogether. Thus, these methods are often implemented on a piece of equipment that is large or expensive and meant to remain stationary. In this way, conventional equipment for generating impulse response filters are often of limited availability and/or usability to consumers.

Many times, an impulse response filter is created using conventional methods in an environment (such as a studio) that is different from the environment that the filter is used to play back with the instrument (such as a user's home or performing venue), or the impulse response filter created for one instrument but is played back using a different instrument. These differences can create an artificial feel to the resulting sound.

Traditionally, mobile phones and microphones that are installed on mobile phones have not been considered to have high quality when compared to studio recording microphones for purposes such as the accurate capture of sound from acoustic and/or electric instruments. Particularly, such captures have been thought to lack sufficient quality/resolution for discerning tasks such as signal processing. Impulse response creation has been primarily centered around studios and studio equipment, which causes a restriction due to cost and availability of using impulse response technology to those that can access studios and/or their related equipment. As well, the playback of these resulting impulse response filters has been centered around tool such as reverberation (reverb) systems and electric guitar speaker cabinet modeling. Some uses for acoustic instruments have been attempted but largely rely on extra studio equipment and techniques such as studio microphones and studio "miking" techniques. Using such things as a mobile device in conjunction with a signal capture and playback device, as in embodiments of the present invention, goes directly against conventional thinking on impulse response creation and playback, adding a substantial new access to people without studio expertise and/or access to studios and studio equipment. An example of utilizing specialized equipment to create an impulse response filter to model sound characteristics of an instrument can be found in U.S. Pat. No. 9,583,088 to May et al., the disclosure of which is incorporated by reference. Embodiments of the invention enable a user to generate a digital audio filter for a particular instrument using portable equipment in a convenient and/or suitable location.

In many embodiments of the invention, a signal processing system may be utilized to create an impulse response filter or other digital audio filter where signal capture and processing tasks are distributed between a mobile device and a signal capture device. The digital audio filter can be generated on a mobile device (such as a smart phone or tablet) using a first audio signal captured on a signal capture device (such as a pedal or other piece of equipment) that is then provided to the mobile device and a second audio signal captured using a microphone on the mobile device. The first audio signal can be obtained from a pickup on an instrument and digitized by the signal capture device. The digitized first audio signal or a frequency domain representation of it (via a Fourier-related transform or similar transform) may be sent from the signal capture device to the mobile device over a wired connection or transmitted via wireless communications. The mobile device can capture a second audio signal using an onboard microphone responsive to the acoustic sound of the instrument. The mobile device combines the digital (e.g., frequency domain) representations of the two signals using a mathematical operation, such as deconvolution, to produce a digital audio filter. In several embodiments, the digital audio filter is an impulse response filter.

The digital audio filter, or filter data characterizing the digital audio filter, can be sent to the signal capture device or another playback device for playing the instrument using the digital audio filter.

While the discussion below describes embodiments of the invention for generating an impulse response filter, one skilled in the art will recognize that other types of digital audio filters may be similarly created using digital representations of analog audio signals using the techniques described here.

Signal Processing System

A signal processing system in accordance with an embodiment of the invention is illustrated in FIG. 1. The signal processing system 100 includes an instrument pickup 102, which can be mounted to or otherwise configured to produce an audio signal from a musical instrument. In various embodiments where the instrument is an acoustic or electric guitar, the instrument pickup 102 can be a magnetic pickup (e.g., soundhole-mounted for acoustic or body-mounted for electric), piezoelectric transducer pickup (e.g., under-saddle) and/or a saddle pickup. In further embodiments, the instrument pickup 102 can be any of a variety of pickups suitable for capturing sound created by the instrument such as, but not limited to, a microphone (such as a reflection cancelling boundary microphone) placed somewhere on the body of the instrument. The microphone may be, for example, inside the body or an acoustic chamber of the instrument or mounted to the outside of the instrument. While pickups on electric guitars have largely been magnetic pickups, optical pickups have also been used. Also, individual per string piezo pickups have also been employed in the bridges on electric guitars. And finally, individual saddle located piezo pickups have been employed on both acoustic and electric guitars. Different types of pickups may have different characteristics, and in turn may be more or less resistant to feedback at various frequencies, have different signal levels, and/or emphasize different frequency ranges. Various pickups and pickup configurations that may be utilized in accordance with embodiments of the invention include those described in U.S. Pat. Nos. 6,023,019; 6,605,771; 7,135,638; 7,157,640; and 8,989,399, the disclosures of which are hereby incorporated by reference in their entireties.

The instrument pickup 102 is connected to a signal capture device 104. A signal capture device 104 may be different form factors in various embodiments. In some embodiments, the capture device is a pedal, while in other embodiments it is a dongle that can attached to the pickup 102. The connection from the instrument pickup 102 to the signal capture device 104 may be an audio cable in some embodiments, or a wireless link in other embodiments. The signal capture device 104 receives a first audio signal from the instrument pickup 102 and creates a digital representation. In some embodiments, the digital representation is a time domain representation, while in other embodiments the digital representation is a frequency domain representation created using a Fourier-related transform or similar mathematical operation.

The digitized representation of the first audio signal is provided to mobile device 106, which can include a processor and instructions in memory (e.g., an application) that directs the processor to perform the instructions. Mobile devices can include smart phones, e.g., Apple iPhone or Android-based phone, as well as portable electronics, e.g., Apple iPad, Android-based tablet, or Windows-based tablets. In many embodiments, the transmission of the digital audio signal is via a wireless link 108, such as a wireless network or a peer-to-peer connection. In other embodiments, a wired connection is utilized. Components of a signal capture device and a mobile device in accordance with several embodiments of the invention are discussed in greater detail further below.

The mobile device 106 captures a second audio signal using a microphone on board the mobile device 106. In other embodiments, an external microphone connected to the mobile device 106 may be used. The second audio signal is digitized and a frequency domain representation created.

In several embodiments, the mobile device 106 performs a resonant modal analysis, using the first audio signal and/or the second audio signal, to predict frequencies where feedback can occur and characterize one or more notch filter(s) or feedback suppression mechanism(s) appropriate to that instrument. In several embodiments, the analysis includes striking one or more strings, playing a chord, tapping on the instrument one or more times, and/or other actions by a user imposed on the instrument to energize resonant modes of the instrument.

In many embodiments, the mobile device 106 generates one or more impulse response filters using the frequency domain representations of the first audio signal and the second audio signal. In some embodiments, the impulse response filter reflects a difference between the first audio signal and second audio signal using a mathematical operation such as deconvolution. In additional embodiments, a hybrid impulse response filter is generated that is a blend between a pure impulse response filter, the first audio signal. and/or the second audio signal. In this way, one or more impulse response filters can be created that characterize tonal characteristics of the instrument.

While a specific signal processing system is discussed above with respect to FIG. 1, one skilled in the art will recognize that signal processing systems in accordance with embodiments of the invention may include different components or be in a different configuration as appropriate to a particular application.

Signal Capture Device

Figure 2:
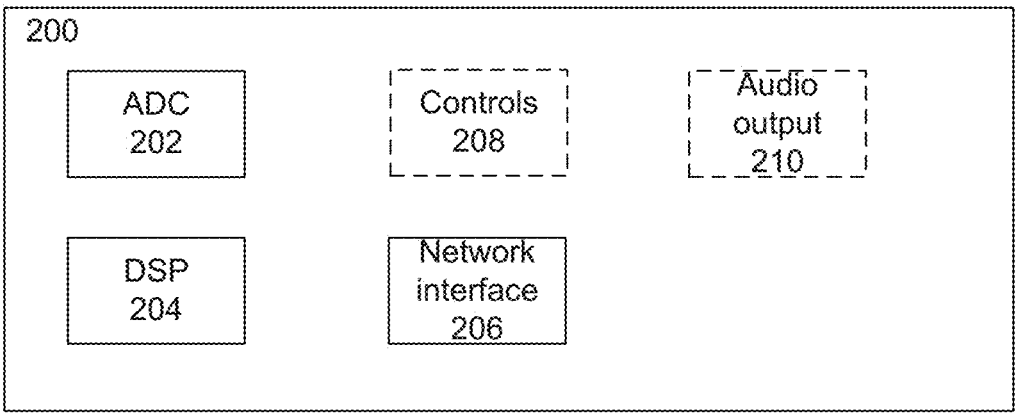
FIG. 2 conceptually illustrates a signal capture device in accordance with embodiments of the invention.

A signal capture device that may be utilized for capturing a first audio signal in accordance with embodiments of the invention is conceptually illustrated in FIG. 2. The signal capture device 200 includes an analog to digital converter (ADC) 202, digital signal processor (DSP) or microprocessor 204, and network interface 206. In additional embodiments, it may also include controls 208 and an audio output 210. The ADC 202 can accept an external audio signal, such as from the pickup of an instrument and digitize the signal. The DSP or microprocessor 204 can packetize or otherwise format the digitized signal for transmission to a mobile device. In some embodiments, the DSP generates a frequency domain representation to provide to the mobile device. In playback mode, the DSP can be used to process the current sound being input with the digital audio filter (e.g., impulse response filter) to produce an output signal.

Network interface 206 can provide a wired (analog or digital) or wireless (e.g., Bluetooth, Wi-Fi, etc.) connection to a mobile device. It can be used to send a digitized representation of the first audio signal captured by the signal processing device to a mobile device and to receive a generated digital audio filter from the mobile device. In certain embodiments, controls 208 may be used to change modes on the signal capture device or adjust levels. Audio output 210 may be used to output the current sound being processed or the sound as modified by the digital audio filter.

Mobile Device

Figure 3:
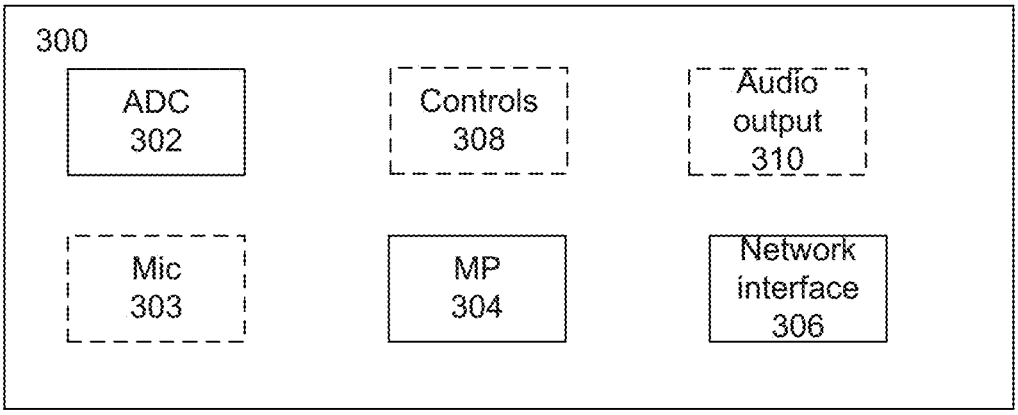
FIG. 3 conceptually illustrates a mobile device in accordance with embodiments of the invention.

A mobile device that may be utilized for capturing a second audio signal in accordance with embodiments of the invention is conceptually illustrated in FIG. 3. The mobile device includes an analog to digital converter (ADC) 302, microphone 303, microprocessor 304, and network interface 306. In additional embodiments, it may also include controls 308 and an audio output 310. The ADC 302 cam accept a second audio signal from the microphone 303 and digitize the signal. Network interface 306 can provide a wired (analog or digital) or wireless (e.g., Bluetooth, Wi-Fi, etc.) connection to a signal capture device. It can be used to receive a digitized representation of the first audio signal captured by the signal processing device and to send a generated digital audio filter to the signal processing device.

The microprocessor 304 can be used to perform filter generation processes using the first and second audio signals as will be described further below. Controls 308 can include a graphical user interface to guide a user through the process and provide settings during playback.

Only recently is the fidelity of on-board microphones of mobile devices and frequency range capability at a level that can be reliably used for audio measurements. In the past, many if not all were not as capable. Furthermore, certain models and/or manufacturers, such as the Apple iPhone, have microphones with consistent specifications across different models. This can benefit the analysis and filter generation process described below, as assumptions and baselines can be utilized to better stabilize the data.

Sound that is captured by the microphone can be conveyed in different ways from the instrument. The sound can be produced acoustically and travel to the microphone in open air. The sound could be captured by an instrument pickup (such as any of the variety of types of pickups discussed further above) and reproduced through an acoustic or electric guitar amplifier or other speaker amplification system.

In additional embodiments of the invention, an external or outboard microphone may be utilized instead of or in addition to the onboard microphone. Various embodiments may utilize different types of microphones such as, but not limited to, third party microphones, plug in microphones, studio microphones, etc. The external or outboard microphone may be connected to the mobile device by an analog audio input or digital connector.

Processes for Generating a Digital Audio Filter

Figure 4:
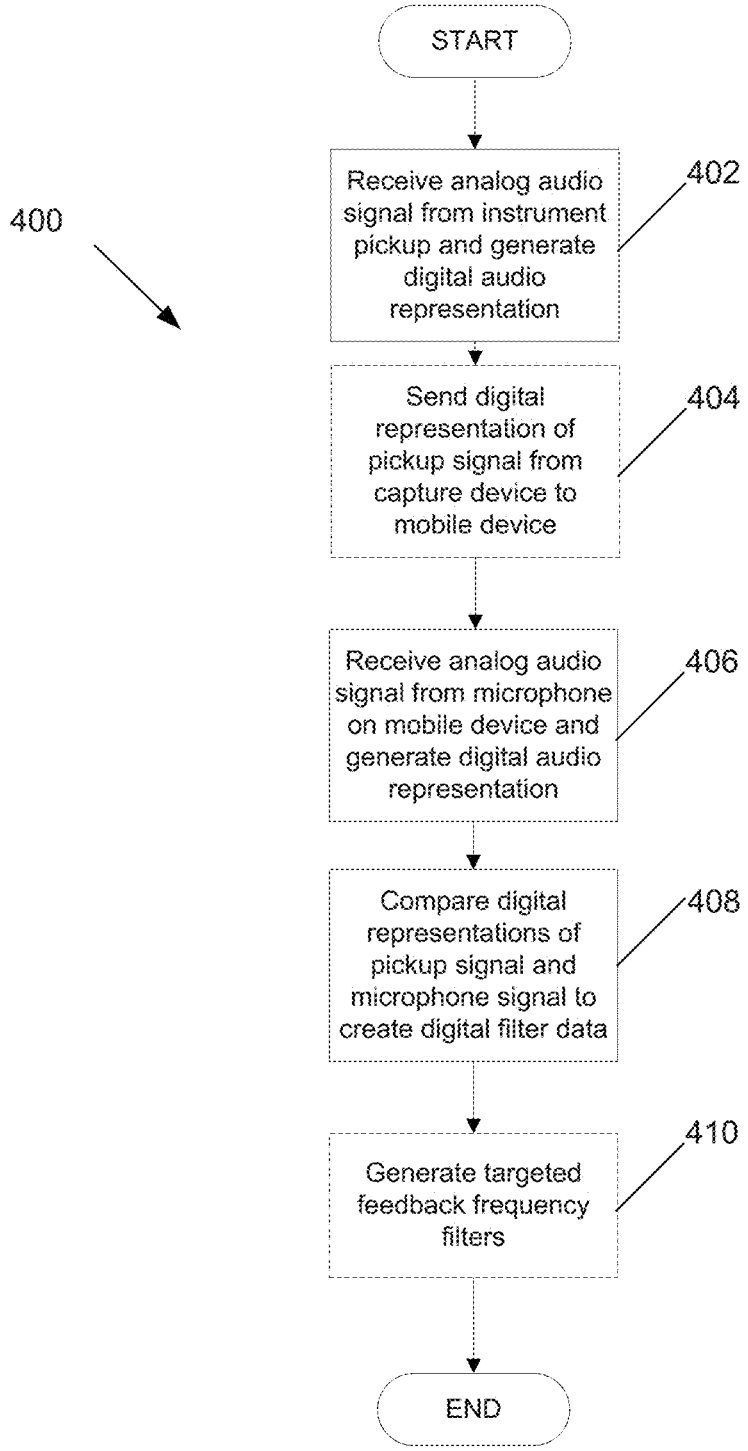
FIG. 4 is a flow chart illustrating a process for processing audio signals to generate a digital audio filter in accordance with embodiments of the invention.

A process for generating a digital audio filter using audio signal processing in accordance with an embodiment of the invention is illustrated in FIG. 4. The process 400 includes receiving (402) a first analog audio signal from an instrument pickup and generating a digital representation of the audio signal, which can be done on a signal capture device. In additional embodiments, the first analog audio signal can be captured by a mobile device. In many embodiments, the first analog audio signal is the result of an acoustic excitation of the instrument by a user. A user may pluck, strum, or otherwise strike the strings to induce the instrument to produce sound. For example, the process may have the user pick certain strings, play scales, or strum multiple strings together, and/or tap the body or other part of the instrument.

In some embodiments, the digital representation is a frequency domain representation (or frequency response spectrum) created by a Fourier-related transform or similar mathematical operation performing Fourier analysis. In several embodiments, a short time Fourier transform (STFT) is used to analyze the sinusoidal components of the first audio signal and produce a frequency spectrum that approximates the first audio signal. A STFT can be beneficial and efficient in building a frequency response immediately (in real-time) without having to record large/long pieces of information. In certain embodiments, the transform takes time chunks or "bins" at 48 kHz (4096 points in time), places results into an accumulator summer, and stacks results in the summer over time until it is roughly stable.

In other embodiments, the digital representation is a time domain representation of the audio signal. The digital representation (frequency or time domain) is provided to a mobile device, such as via wireless connection (404) (e.g., Bluetooth, Wi-Fi, etc.). In other embodiments, a wired connection may be used. In certain embodiments utilizing frequency domain representation, only half the data needs to be transmitted based on the assumption that the frequency response is mirrored around a center point. The mirrored data can be reconstructed when received. In further embodiments, the data is brought down to 48 k and interpolated up to 96 k after it is received.

The mobile device receives (406) a second analog audio signal using a microphone, which is digitized. The digitized second audio signal can be converted to a digital representation in similar fashion as described above with respect to the first audio signal. In several embodiments, the microphone captures sound emanating through air from an acoustic guitar or other acoustic stringed instrument. In many embodiments, the second analog audio signal is generated from the same instance of acoustic excitation of the instrument that produced the first analog audio signal. In other embodiments, the second analog audio signal is generated from a separate instance of acoustic excitation by a method such as those described above.

In other embodiments, the microphone captures sound produced by speaker or amplifier (e.g., when connected to an electric guitar). In such embodiments, the signal capture device may output an audio signal (which may be a modified version of the first audio signal passed through the signal capture device) to a speaker or amplifier. Alternatively, the audio signal from the instrument pickup may be split before going into the signal capture device and provided to both the signal capture device and the speaker or amplifier.

The mobile device generates (408) a comparison between the digital representation of the first audio signal and the digital representation of the second audio signal to create a filter data that characterizes a digital audio filter. The comparison can include a deconvolution of the elements of the frequency response spectrum of one audio signal with the elements of the frequency response spectrum of the other audio signal. For example, in several embodiments the digital audio filter is an impulse response filter and the filter data are filter coefficients that define the impulse response filter. One skilled in the art will appreciate that other types of digital audio filters may be created using digital representations of the two audio signals in accordance with embodiments of the invention.

In some embodiments, the mobile device generates (410) targeted feedback filters, e.g., notch filters, at a certain frequency or frequencies to reduce the likelihood of feedback. In several embodiments, the digital representation of the second analog audio signal is used to create targeted feedback filters. Addition discussion concerning feedback filters can be found further below.

The digital audio filter (for example, an impulse response filter) may be used to modify a new audio signal from an instrument (the same instrument used to generate the filter or another instrument) such as in processes discussed further below. While a specific process is discussed above with respect to FIG. 4, one skilled in the art will recognize that processes for signal processing in accordance with embodiments of the invention may vary in implementation as appropriate to a particular application. For example, other sequences of activities to excite the strings and/or body of the instrument may be utilized and other types of digital audio filters can be created using different mathematical operations.

Processes for Applying a Digital Audio Filter to Instrument Sound

Figure 5:
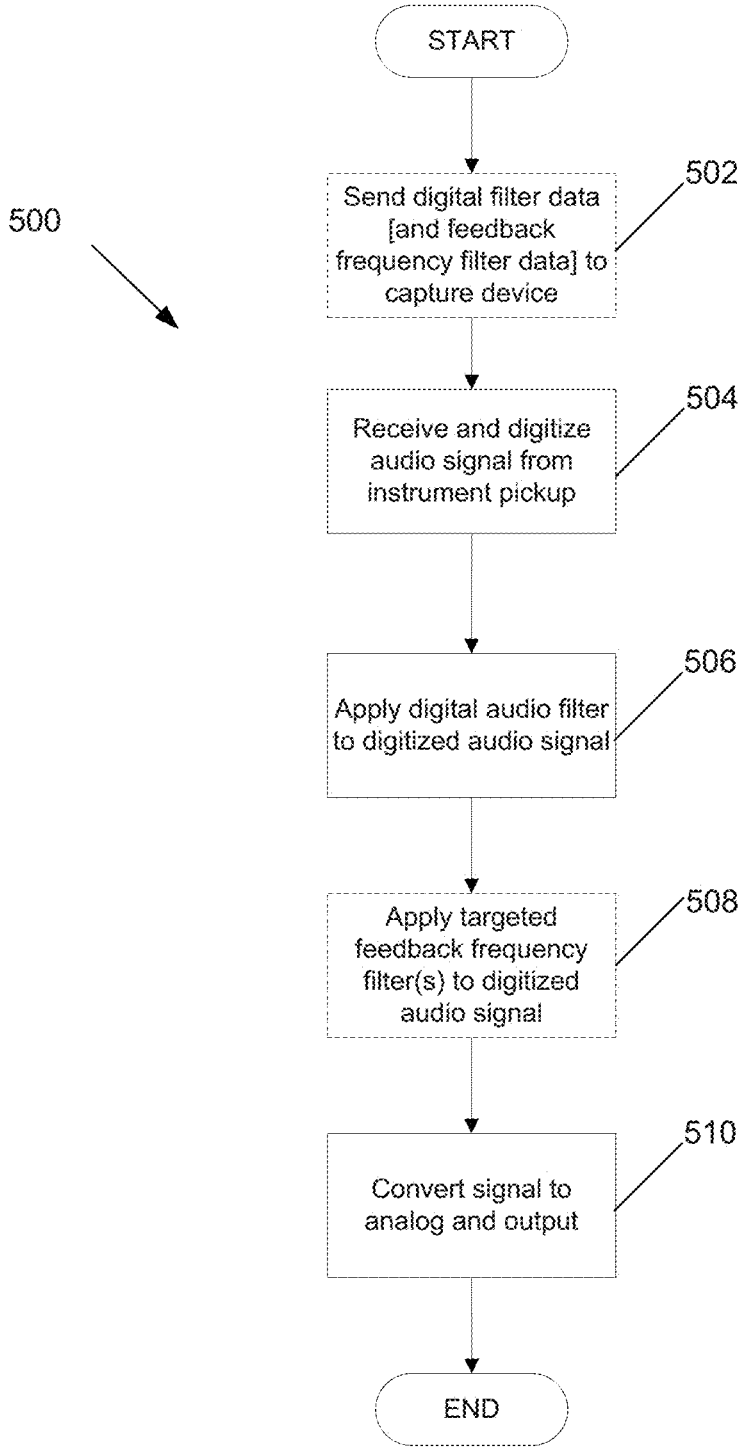
FIG. 5 is a flow chart illustrating a process for playing new audio from an instrument modified by a digital audio filter in accordance with embodiments of the invention.

Using a digital audio filter, a new audio signal, for example one captured by a pickup or the microphone, can be processed to generate an audio signal with imparted characteristics from the impulse response filter such that it is perceived as likely having been captured by a microphone than a pickup. In many embodiments, this is achieved by convolution in the time domain with the audio signal and the digital audio filter. In further embodiments, the new audio signal includes a weighted blend of the microphone signal, the pickup signal, and/or the filter-modified signal (from the pickup or microphone). In even further embodiments, a visual equalizer (EQ) is provided to a user to adjust relative strengths of frequencies in the audio being played of any of the signals or the total blend of the signals. A process for modifying an audio signal using a digital audio filter in accordance with embodiments of the invention is illustrated in FIG. 5.

The process 500 can include sending the digital filter data characterizing a digital audio filter, or other information from which the digital audio filter can be constructed, from a mobile device to a signal capture device. In some embodiments, feedback frequency filter data describing feedback filters can also be sent. In many embodiments, the mobile device is the one that created the filter data and/or digital audio filter. In further embodiments, the digital filter data is sent from the mobile device to a different device used for playing audio from the instrument.

The signal capture device (or another device used for playing back) receives and digitizes 504 an audio signal from a pickup on the instrument. If the digital audio filter is not yet constructed, it constructs the digital audio filter from the filter data. It applies 506 the digital audio filter to the digitized audio signal. In further embodiments, a microphone signal and/or an unmodified pickup audio signal can be blended together with the pickup signal modified by the digital audio filter.

In several embodiments, the targeted feedback frequency filter(s) are applied (508) to the digitized audio signal. In some embodiments, the targeted feedback frequency filter(s) are combined with the digital audio filter, while in other embodiments the filters remain separate. When the filters remain separate, they may have individual level controls to control the magnitude of the effect. The signal can be converted to analog and output (510) from the signal capture device. While a specific process is discussed above with respect to FIG. 5, one skilled in the art will recognize that processes for signal processing in accordance with embodiments of the invention may vary in implementation as appropriate to a particular application.

Feedback Filters

As discussed above, the digital audio filter generation process can include identifying potential feedback frequencies and applying some attenuation. Typically, in acoustic guitars there is an air resonance and a drumhead or primary resonance that are vastly higher than information at other frequencies. Traditional methods of reducing feedback are to ring the guitar out at a volume that induces feedback, identify the frequencies that are feeding back, and devise a notch filter at those frequencies. This is usually not that precise and suppresses too much information around the identified frequencies.

During a digital audio filter generation process in accordance with embodiments of the invention, the frequency response of the body of the instrument can be measured to predict at which frequencies the body is going to feed back. In several embodiments, the analysis includes striking one or more strings, playing a chord, tapping on the instrument one or more times, and/or other actions by a user imposed on the instrument to energize the instrument. Such actions may be included in the actions used to generate first (402) and second (406) audio signals discussed further above.

When analyzing the frequency response in the frequency domain, a filter such as a low-pass filter can be imposed on the response and the peaks (usually two or three) can be identified. For example, in many embodiments, the analysis can construct a parametric view of the events energizing the instrument and measure the height (e.g., amplitude), Q, and location (e.g., frequency) of peaks in the spectrum. Note that the peaks may not have the same height and different levels of suppression may be appropriate.

A notch filter to attenuate these frequencies can be incorporated into the digital audio filter reducing the amplitude of these frequencies when the instrument is played back, for example, in combination with using the digital audio filter. In several embodiments, the notch filter can progressively apply greater suppression at certain target frequencies when the degree is higher or have dynamic level control depending on the signal level or sound pressure level (SPL). In some embodiments, the strength of the notch filter relative to the signal is further adjustable by a user using a level control. Furthermore, the Q and/or depth of each frequency may be modified via level control or automatically during the analysis.

One skilled in the art will recognize that peak filters and other types of narrowband gain or loss filters, in addition to notch filters, may be utilized as appropriate in various embodiments of the invention.

While the above description contains many specific embodiments of the invention, these should not be construed as limitations on the scope of the invention, but rather as an example of one embodiment thereof. Accordingly, the scope of the invention should not be limited to the specific embodiments illustrated.

What is claimed is:

1. A method for creating a digital audio filter using a pickup audio signal provided to an instrument signal capture device and a microphone signal provided to a mobile device, the method comprising:

capturing and digitizing at least one segment of a first audio signal using a signal capture device;

performing frequency analysis on the at least one digitized segment of the first audio signal to generate a frequency response spectrum representation of the first audio signal using the signal capture device;

transmitting the frequency response spectrum representation of the first audio signal from the signal capture device to a mobile device;

capturing and digitizing at least one segment of a second audio signal using a microphone on the mobile device;

performing frequency analysis on the at least one digitized segment of the second audio signal using the mobile device to generate a frequency response spectrum representation of the second audio signal using the mobile device; and generating filter data that characterizes a digital audio filter from the frequency response spectrum representation of the first audio signal and the frequency response spectrum representation of the second audio signal using the mobile device.

2. The method of claim 1, wherein the digital audio filter is an impulse response filter and the filter data comprises filter coefficients that define the impulse response filter.

3. The method of claim 1, wherein:

the at least one segment of a first audio signal is a plurality of segments of the first audio signal; and the at least one segment of a second audio signal is a plurality of segments of the second audio signal.

4. The method of claim 1, further comprising:

transmitting the generated filter data from the mobile device to the signal capture device;

generating a digital audio filter from the filter data;

capturing and digitizing a third audio signal in real-time using the signal capture device;

processing the third audio signal using the digital audio filter using the signal capture device; and outputting a modified output signal from the processed third audio signal.

5. The method of claim 1, further comprising performing a resonant modal analysis using the at least one digitized segment of the second audio signal to determine one or more frequencies where feedback is anticipated and characterizing at least one targeted feedback filter for the one or more determined feedback frequencies using the mobile device.

6. The method of claim 5, further comprising:

transmitting the generated filter data and data characterizing at least one targeted feedback filter from the mobile device to the signal capture device;

generating a digital audio filter from the filter data and at least one targeted feedback filter from the data characterizing at least one targeted feedback filter;

capturing and digitizing a third audio signal in real-time using the signal capture device;

processing the third audio signal using the digital audio filter and at least one targeted feedback filter using the signal capture device; and outputting a modified output signal from the processed third audio signal.

7. The method of claim 1, wherein performing frequency analysis on each captured segment of the first audio signal to generate a frequency response spectrum representation of the first audio signal comprises performing a Short-Term Fourier Transform (STFT) on each captured segment and accumulating the results; and performing frequency analysis on each captured segment of the second audio signal to generate a frequency response spectrum representation of the second audio signal comprises performing a Short-Term Fourier Transform (STFT) on each captured segment and accumulating the results.

8. The method of claim 1, wherein capturing and digitizing at least one segment of a first audio signal using a signal capture device comprises capturing the at least one segment of the first audio signal from an electric guitar; and capturing and digitizing at least one segment of a second audio signal using a microphone on the mobile device comprises capturing sound using the microphone on the mobile device from a speaker driver that is producing sound from the electric guitar.

9. The method of claim 8, where the microphone on the mobile device is an external third-party microphone connected to the mobile device.

10. The method of claim 1, wherein the transmitting the frequency response spectrum representation of the first audio signal from the signal capture device to a mobile device utilizes wireless communications.

11. A signal processing system for creating a digital audio filter using a pickup audio signal provided to an instrument signal capture device and a microphone signal provided to a mobile device, comprising:

a signal capture device comprising:

an audio input;

an analog to digital converter;

a microprocessor;

a network interface; and a mobile device comprising:

a microphone;

an analog to digital converter;

a microprocessor; and a network interface;

where the signal capture device is configured to:

capture and digitize at least one segment of a first audio signal using the audio input;

perform frequency analysis on the at least one digitized segment of the first audio signal to generate a frequency response spectrum representation of the first audio signal; and transmit the frequency response spectrum representation of the first audio signal to a mobile device;

where the mobile device is configured to:

capture and digitize at least one segment of a second audio signal using the microphone;

perform frequency analysis on the at least one digitized segment of the second audio signal to generate a frequency response spectrum representation of the second audio signal;

generate filter data that characterizes a digital audio filter from the frequency response spectrum representation of the first audio signal and the frequency response spectrum representation of the second audio signal using the mobile device.

12. The system of claim 11, wherein the digital audio filter is an impulse response filter and the filter data comprises filter coefficients that define the impulse response filter.

13. The system of claim 11, wherein:

the at least one segment of a first audio signal is a plurality of segments of the first audio signal; and the at least one segment of a second audio signal is a plurality of segments of the second audio signal.

14. The system of claim 11, wherein the mobile device is further configured to:

transmit the generated filter data to the signal capture device;

wherein the signal capture device is further configured to:

generate a digital audio filter from the filter data;

capture and digitize a third audio signal in real-time using the signal capture device;

process the third audio signal using the digital audio filter using the signal capture device; and output a modified output signal from the processed third audio signal.

15. The system of claim 11, wherein the mobile device is further configured to perform a resonant modal analysis using the at least one digitized segment of the second audio signal to determine one or more frequencies where feedback is anticipated and characterizing at least one targeted feedback filter for the one or more determined feedback frequencies.

16. The system of claim 15, wherein the mobile device is further configured to:

transmit the generated filter data and data characterizing at least one targeted feedback filter to the signal capture device;

wherein the signal capture device is further configured to:

generate a digital audio filter from the filter data and at least one targeted feedback filter from the data characterizing at least one targeted feedback filter;

capture and digitize a third audio signal in real-time using the signal capture device;

process the third audio signal using the digital audio filter and at least one targeted feedback filter using the signal capture device; and output a modified output signal from the processed third audio signal.

17. The system of claim 10, wherein performing frequency analysis on each captured segment of the first audio signal to generate a frequency response spectrum representation of the first audio signal comprises performing a Short-Term Fourier Transform (STFT) on each captured segment and accumulating the results; and performing frequency analysis on each captured segment of the second audio signal to generate a frequency response spectrum representation of the second audio signal comprises performing a Short-Term Fourier Transform (STFT) on each captured segment and accumulating the results.

18. The system of claim 11, wherein capturing and digitizing at least one segment of a first audio signal comprises capturing the at least one segment of the first audio signal from an electric guitar; and capturing and digitizing at least one segment of a second audio signal using a microphone comprises capturing sound using the microphone on a mobile device from a speaker driver that is producing sound from the electric guitar.

19. The system of claim 11, here the microphone on the mobile device is an external third-party microphone connected to the mobile device.

20. The system of claim 11, wherein:

the network interface of the signal capture device and the network interface of the mobile device are configured for wireless communications; and the transmitting the frequency response spectrum representation of the first audio signal from the signal capture device to a mobile device utilizes wireless communications.

* * * * *